United States Patent [19]

Teachout et al.

[11] Patent Number: 4,975,987

[45] Date of Patent: Dec. 11, 1990

[54] CLOTHING ORNAMENTATION SYSTEM AND ATTACHMENT MECHANISMS

[76] Inventors: James F. Teachout; Tammy S. Teachout, both of 3545 E. Ventana Canyon Dr., Tucson, Ariz. 85718

[21] Appl. No.: 278,719

[22] Filed: Dec. 2, 1988

[51] Int. Cl.[5] ..... A44B 21/00

[52] U.S. Cl. ..... 2/246; 2/75; 2/80; 2/244; 24/442; 24/306; 446/26; 446/28

[58] Field of Search ..... 2/49 R, 49 A, 75, 80, 2/83, 111–115, 217, 244, 246, 271, 311, 312, 338, 244; 24/49 K, 163, 98, 306, 442; 446/25, 26, 27, 28

[56] References Cited

U.S. PATENT DOCUMENTS

| | | | |
|---|---|---|---|
| 1,473,789 | 11/1923 | Killfeather | 2/75 |
| 2,164,252 | 6/1939 | Merrigan | 2/246 |
| 2,582,699 | 1/1952 | Jelaso et al. | 2/75 X |
| 2,999,245 | 9/1961 | Lippman | 2/246 |
| 3,605,300 | 9/1971 | Moore | 2/246 X |
| 3,816,211 | 6/1974 | Haigh | 2/246 X |
| 3,997,921 | 12/1976 | Knight | 2/75 |
| 4,220,302 | 9/1980 | Hampton et al. | 24/306 X |
| 4,403,366 | 9/1983 | Lucke | 24/306 X |
| 4,597,197 | 7/1986 | Strasinger | 2/338 X |
| 4,604,758 | 8/1986 | Grasberger et al. | 2/49 R |
| 4,706,914 | 11/1987 | Ground | 24/306 X |
| 4,710,979 | 12/1987 | Bull et al. | 2/49 R |
| 4,723,323 | 2/1988 | Wright, Jr. | 2/49 R |
| 4,759,963 | 7/1988 | Uso, Jr. et al. | 24/442 X |
| 4,776,043 | 10/1988 | Coleman | 2/185 R |
| 4,800,594 | 1/1989 | Young | 24/442 |

FOREIGN PATENT DOCUMENTS 733747 4/1943 Fed. Rep. of Germany .

OTHER PUBLICATIONS

Gershmann, Maurice, "Self Adhering Nylon Tapes" The JAMA, vol. 168, No. 7, p. 930, Oct. 1958.

*Primary Examiner*—Werner H. Schroeder
*Assistant Examiner*—Jeanette E. Chapman
*Attorney, Agent, or Firm*—Leydig, Voit & Mayer

[57] ABSTRACT

An attachment mechanism and system, for the ornamentation of and on articles of clothing (i.e., shirts, blouses, dresses, pants, skirts, shorts, overalls, jackets, etc.). The article of clothing has a first strip of material, the system's receiving loop forming element, affixed to it. This strip is sewn or otherwise attached at its two ends to the article of clothing, leaving the center section spaced from the article to form the receiving loop upon the article of clothing. This receiving strip can be attached to any chosen display area upon the garment's exterior. Customized fabric receiving strips could also become the clothing manufacturer's vanity/display label. In one embodiment, the ornamentation, preferably of soft composition, has an attachment strip attached to the back side or it's top section wherein the strip ends are releasably interconnected to form an attachment loop. One end of the strip providing the open attachment loop extends through the receiving loop and closes to itself, end to end, thereby interlocking the attachment loop to the receiving loop and completing the ornament attachment. Variations include a second receiving loop on the ornament; ornaments with a slotted back; or a third loop, eyelet or clip used to complete the ornament to garment attachment.

14 Claims, 2 Drawing Sheets

CLOTHING ORNAMENTATION SYSTEM AND ATTACHMENT MECHANISMS

BACKGROUND

The invention relates to an attachment mechanism and system used to accessorize, customize and/or personalize articles of clothing. More particularly, this invention presents a safe and easy system for the attachment and detachment of ornaments or decorative emblems to clothing. This invention allows both the manufacturer and/or wearer to promote and display theme material of their own choosing, with the freedom to change the material or message without having to change garments.

For as long as there has been men and women, there has been the desire to place ornaments, emblems or other types of decoration on the garments they wear. In fact, the earliest and most common archaeological items of evolved civilizations are found to be ornamentations and adornments.

Modern man has not changed in this matter. World cultures still desire and promote the addition of colored emblems or other such distinctions to their garments, to make them more personal to the wearer, and/or to make a vanity statement for both manufacturer and wearer. Although the desire to make such personal expressions has not diminished, the methods of clothing personalization have evolved from embroidery to common fabric printing and stitching. These common methods appertain an article of clothing to a specific theme, event or vanity statement as they are permanently applied to the clothing.

Certain other methods for limited ornamentation on articles of clothing have also been developed and designed. One such recent method is described in U.S. Pat. No. 4,597,198, entitled "Ornamental Attachment for Footwear and the Like" issued July 1, 1986, to Schweitzer. This apparatus utilizes the lacing of a shoe to attach an ornament. Because of it's structure, this method of attachment requires manual dexterity and the use of both hands; and since it relies on lacing to attach ornaments, it's application is also very limited.

Another attachment mechanism is described in U.S. Pat. No. 2,793,413, entitled "Combination Loop and Fastening Device", issued May 28, 1957, to Oder. This device utilizes wire lengths fabricated with a pair of sharp ended spikes; these spike ends then assist in the attachment of a wire loop to certain articles of clothing. It is apparent that this device, and others like it, pose a significant "safe use" problem for either small children or the infirmed who do not have the steady hands necessary to properly pin and spread the anchor spikes. Further safety considerations exist in the fact that the wearer then carries the spike anchor portion, which is bent on the underside of the material, against their person.

Another class of mechanism used to fasten items to clothing has focused on the shoulder area of shirts and blouses, and more particularly to the attachment of shoulder straps and/or military epaulets to the shoulder. One such device is described in U.S. Pat. No. 2,476,712, entitled "Blouse Shoulder Strap", issued July 19, 1949, to Eisenberg. This device deals with the formation of a holding and positioning means located over the shoulder, especially in women's apparel. The holding epaulet is formed of several folds of cloth with one element stitched to the shoulder area. Snaps close the top element to the main element to form an epaulet for holding tape-like components over the shoulder. Beyond it's limited application, this device does not create an environment for novel or fun type ornamentation as the epaulet is styled in the military look. Further, this device also requires substantial dexterity to operate.

Other types of epaulet arrangements are described by U.S. Pat. No. 2,999,245, entitled "Shirt", issued Sept. 12, 1961, to Lippman; and U.S. Pat. No. 111,456 entitled "Epaulet" issued Jan. 31, 1871, to Horshmann. Again, both of these patents incorporate military styled epaulets at or on the shoulder area and they rely on hard metal components to operate.

It is clear from the foregoing analysis and background that the prior examples referred to are only limited or even single use attachment mechanisms for clothing ornamentation. It is the object of the present invention to provide not only a simplified and safe attachment mechanism, but to provide a complete and extended use system for clothing and garment ornamentation and accessorizing. The invention offers real flexibility with virtually unlimited application.

Further objectives of this invention are: to provide a complete system for ornamentation and/or accessorizing which can be utilized on virtually any article of clothing or garment; to provide a system which can, in part or whole, be applied and utilized by both the clothing/garment manufacturer and the wearer; to provide a complete system that could be made available through the clothing manufacturer, at the point of sale, and/or through the after sale garment/accessory market; to provide a system where the receiving component, when displayed as the manufacturer's label, could stand as a single element vanity statement; to provide a system where customized or thematic statements on articles of clothing can be changed by simply changing accessories; to add flexibility and to allow for changes of personal choice within the customized or thematic clothing industry; to provide a system which can be used and enjoyed by all age/social groups, including children and the enervated, as even limited systems are not currently available to these segments; to provide a system which can be readily and economically fabricated, and yet one which exhibits reasonably long life.

SUMMARY OF THE INVENTION

This invention utilizes separate and interlocking units of cloth, or other such flexible material. One unit is attached to a chosen display area upon the article of clothing or garment. This unit of material is a relatively narrow and elongated strip with its two ends sewn or otherwise attached to the article of clothing, where upon its center section is left open to thus form a receiving loop upon the garment. In the preferred embodiment, the flexible strip which forms the receiving loop is attached to the article of clothing in a horizontal position, such that it extends substantially horizontal to the ground, when the article of clothing is worn.

The second unit of cloth, or other such material, is also an elongated, flexible strip which is made narrow enough to pass through the open area of the formed receiving loop. This second unit of material, or strip, has self connecting, releasable fasteners at its two ends, which allows for an end to end closing/opening and thereby the formation of an operable and removable attachment loop. In this embodiment the attachment mechanism used to self close the ends of the second unit of material is a hooking material, such as Velcro, or the like. Other suitable fasteners offered include button or snap elements. Those of ordinary skill in the art would readily and easily recognize other suitable end fasteners for this application.

In employing the system of this invention offered here, the open attachment loop is permanently anchored at manufacture, or temporarily attached after manufacture, to a series of ornaments, emblems and/or other such symbols. When permanently anchored, the attachment strip is sewn or otherwise fixed to an appropriate back or top section of the ornament. Certain types of adornments could also be manufactured with either slotted back material, or with an added eyelet of sufficient size for the attachment loop to be passed or looped through. This elective ornament feature would then be used to temporarily secure/hold the attachment loop to the ornament. Another variation of attachment could find ornaments manufactured with a clip device on their backside, with the clip then being hooked at and through the open section of the garment's receiving loop.

When attaching an ornament to the article of clothing, an open end of the ornament connected attachment strip is passed through the open section of the garment's receiving loop. The attachment strips' opposite ends are then closed to each other, by their fastening elements, and thus form the attachment loop.

This creates a transient interlock of the attachment loop which is provided with or at the ornament, and the anchored receiving loop which is pre-mounted on the garment. With this system, a variety of ornaments can be temporarily attached and interchanged between selected articles of clothing.

In the preferred embodiment all components, from the interlocking loop sections through the sundry of ornaments, would be produced of flexible materials, such as any of the many different fabrics used in the manufacture of garments/articles of clothing.

Ornaments may be filled with soft fiber, such as cotton or spongy foam. The selection of soft material ornaments is very important when the adornment is to be worn by young children, as a hard material element could injure the wearer in a fall. Further, looping devices and ornaments of soft composition provide a system with built-in safety elements for the unstable user and/or wearer.

The receiving strip, which forms the receiving loop when it is attached to the article of clothing, can become a designer's accent or vanity label. When custom embroidered or printed with logos, symbols, statements, or such other identities it is presented as a manufacturer's/designer's vanity or display label. This would permit the "receiving strip to garment applicator" to stylize the garment with this single element and yet when in place, the formed/applied loop also provides the receiving half of the ornament attachment system.

Alternatively, in another embodiment of this invention, the receiving strip/loop could be made of a material which is similar in pattern and/or color to that of the garment which it is to be attached to. This composition would allow the receiving loop to blend with the garment material and when in place, the receiving loop would then appear as a fashionable designer's accent or relief upon the garment's surface.

The ease and versatility of this ornament attachment system is a system where customized or thematic expressions on articles of clothing can be changed by the user or wearer simply by changing the ornamentation. This is demonstrated through the unrestricted placement of the receiving and attachment loops, and the ability to personally select from the endless variety of adornments. With placement of the attachment mechanism to the garment's exterior, and with the uncomplicated appendage procedures, this system is demonstrated to be workable even by those with limited motor skills.

Further objects and advantages will become apparent from the following description taken in conjunction with the accompanying drawings, in which:

DETAILED DESCRIPTION OF THE INVENTION

Figure 1:
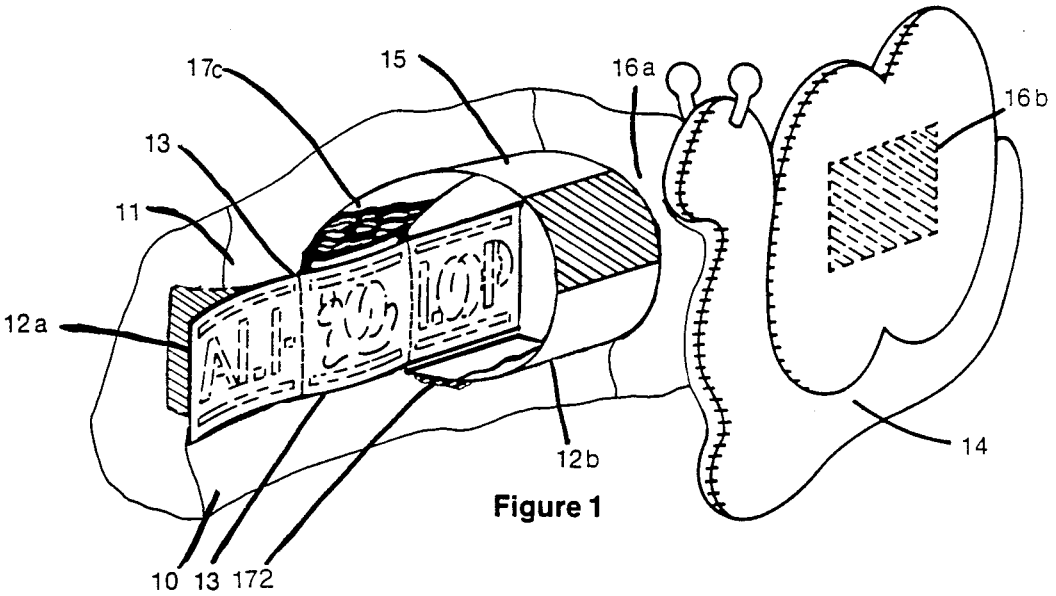
FIG. 1 is an enlarged perspective view of the receiving loop; attachment loop; ornament; and garment/clothing section. This exploded view shows the principal elements which embody the present invention.

FIG. 1 illustrates the preferred embodiment of the present invention. An article of clothing generally designated by the numeral 10 has a receiving strip 11 of material forming a receiving loop affixed to it. The receiving strip 11 is sewn or otherwise attached at its two ends 12*a* and 12*b* and the center section 13 is spaced from the article and forms the receiving loop upon the article of clothing. In the preferred embodiment, the receiving strip 11 is attached to the article of clothing 10 and located on the article in a horizontal position, such that it extends substantially horizontally and parallel to the ground when the article of clothing is worn by a wearer, so that the receiving loop has a substantially vertical axis.

In accordance with the invention, this horizontal arrangement will allow the ornament 14 to be secured in front of the center section 13 of the receiving strip 11 by attachment strip 15 which forms an attachment loop, which is interlocked with the receiving loop and this horizontal mounting of the receiving loop will keep the ornament 14 from sliding to a lower end of the receiving loop (or slot) as it could if the receiving strip was mounted vertically. In this illustration, the ornament 14 has an attachment strip 15 affixed at the front 16*a* of the attachment strip 15 to the ornament's back side 16*b*. The attachment strip ends 17*a* and 17*b* are releasably connected to each other and thus they can close and open to and from each other and form an attachment loop. Further in this illustration, the attachment strip ends 17*a* and 17*b* are shown to be connected using Velcro material, however, other suitable end fasteners could include button or snap elements, or the like.

The end 17*a* of the attachment strip 15 is through the open loop behind the center section 13 of the garment's pre-mounted receiving strip 11, the center section 13 being spaced from the garment to form the receiving loop, after which the attachment strip ends 17*a* and 17*b* are attached to each other to form the attachment loop. The portions of the attachment strip 15 are thus interlocked to form an attachment loop which extends through the open center of the receiving loop formed by the receiving strip 11 and the ornament 14 attachment to the article of clothing 10 is completed.

Figure 2A:
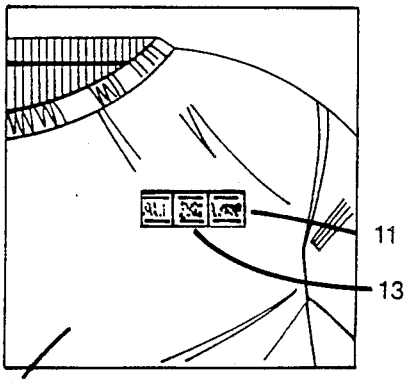
FIGS. 2A and 2B represent placement and enlargement, front views of the receiving element utilized to form the receiving loop upon the garment's exterior. In these figures the receiving loop is shown custom finished as a manufacturer's vanity/display label.
Figure 2B:
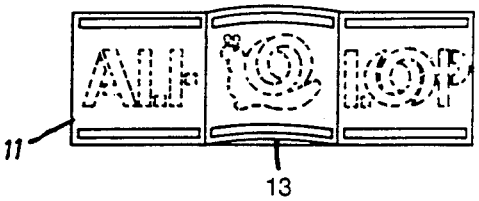

FIGS. 2A and 2B detail the receiving loop forming element of the invention. FIG. 2A shows the placement of the receiving strip 11, with its center section 13, at the breast area of a casual shirt 10. Although this illustration depicts a shirt 10, and the mounting of the receiving strip 11 is demonstrated at the shirt 10 breast area, this invention is wearable on, and applicable to, any article of clothing and any display area the manufacturer or wearer may choose. When this system is utilized by children or persons with limited motor skills or capabilities, positioning and placement of the receiving strip 11 at the front of the garment 10 facilitates the action of changing or interchanging of ornaments by such wearers. FIG. 2B is a front view enlargement of the receiving strip 11 with the center section 13 providing a loop to receive an ornament attachment strip. As shown here, the receiving strip 11 is shown as having been custom embroidered as a manufacturer's vanity label. This arrangement permits the applicator of the receiving strip 11 to stylize the garment with this single element and when in place, the receiving strip 11 provides the receiving loop half of the ornament attachment system.

Figure 3A:
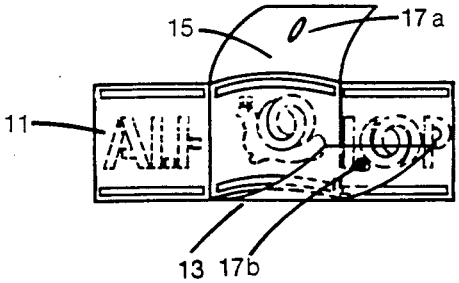
FIGS. 3A and 3B represent front views of the attachment element utilized to form the attachment loop at/upon the ornament; and to show the attachment strip as it is looped through the open segment of the receiving loop.
Figure 3B:
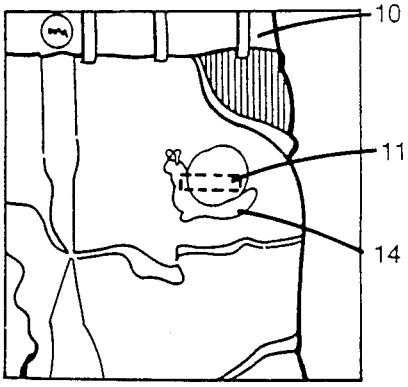

FIGS. 3A and 3B detail the attachment loop forming element of this invention. Here the small scale FIG. 3B shows an ornament 14 in place at the pocket area of a pair of pants 10; and with the approximate placement of the receiving strip 11 on the garment 10 shown in hidden line, the receiving loop in this arrangement would be covered by the oversized ornament 14. FIG. 3A is a larger scale front view which shows the interconnection of the attachment strip 15 through the receiving loop formed by the strip 11 at the receiving strip 11 behind the center section 13. In this example, the attachment strip ends 17*a* and 17*b* are shown to connect to each other by way of snap elements.

Figure 4:
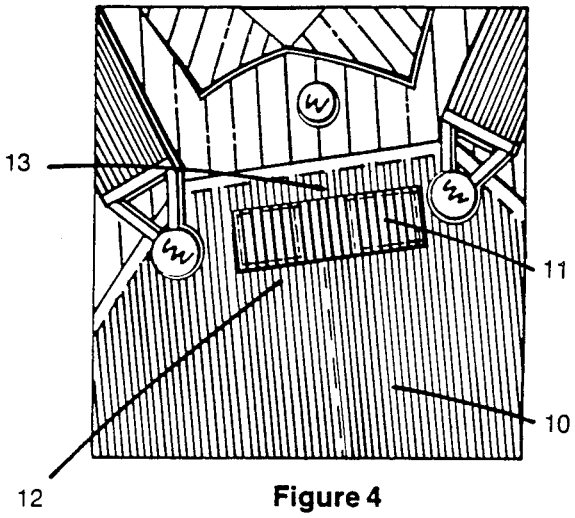
FIG. 4 is also a front view of the receiving element in place, wherein the formed receiving loop is fashioned of the same material as the garment.

FIG. 4 is a front view representation of the receiving strip 11 manufactured of material similar in pattern, texture and color as the article of clothing 10 upon which it is placed. Here, the receiving strip 11 is shown with its ends 12*a* and 12*b* stitched in place at the bib area of a pair of bib-overalls 10. This allows the receiving strip 11, with its center section 13, to blend with the garment material, and thus the receiving strip 11 appears as a simple designer accent or relief element upon the garment surface.

Figure 5:
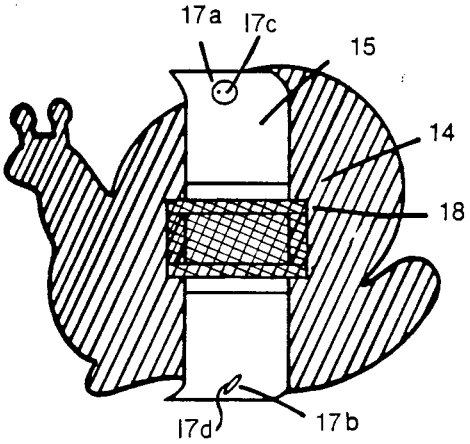
FIG. 5 is a rear view of an ornament provided with a slotted back and with the attachment strip temporarily looped through said slot(s).

FIG. 5 is a rear view of an ornament 14 which has been manufactured with a slotted back 18 for the attachment strip 15 to loop through. In this figure, the attachment strip ends 17*a* and 17*b* have been shown to connect to each other by way of buttoning elements 17*c* and 17*d*.

Figure 6:
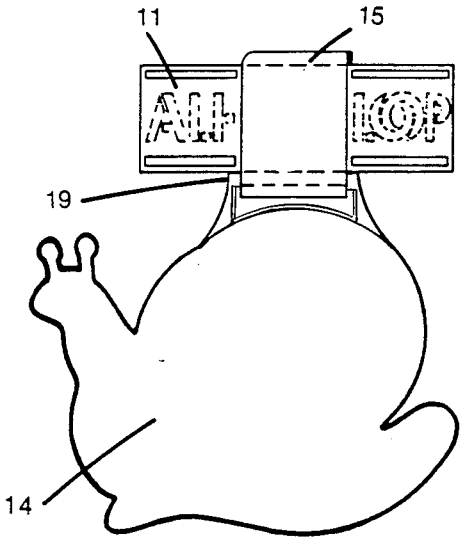
FIG. 6 is a front view of another ornament variation, wherein an eyelet is fashioned at the top of the ornament.

FIG. 6 is a front view of another alternative ornament attachment configuration. In this figure the ornament 14 is manufactured or fashioned with an added eyelet 19 at its top center. The attachment strip 15 is looped through the ornament 14 eyelet feature 19 prior to being passed through, and thus interconnected to, the garment's receiving loop formed by the strip receiving 11.

Figure 7:
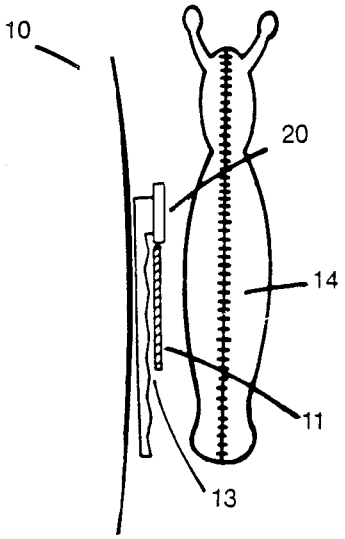
FIG. 7 is a side view of another variation wherein the ornament is secured to the garment's receiving loop by a clip device.

FIG. 7 is an end view of still another ornament attachment configuration alternative. Here the ornament 14 is manufactured with an attachment clip device 20 pre-mounted and anchored at its back. In this embodiment, the ornament 14 is simply clipped at the center section 13 of the garment's pre-mounted receiving strip 11.

The ornament carrying receiving strip may be anchored to any article of clothing, or any outerwear, and it may be placed at any chosen location upon such raiment. In the preferred embodiments, the material used in fabricating the elongated receiving strip would be of a soft, flexible composition. This receiving strip could be custom finished, as a manufacturer's vanity label, or as a designer accent when finished in materials similar in composition and color to the garment or ornament material(s). The center portion of the receiving strip is left open to form a loop to "receive" the ornament attachment strip. Securing the ends of the receiving strip to the garment can be accomplished in any conventional manner, i.e., stitching, adhesives, etc.

The ornament to garment attachment strip can be anchored to the ornament at manufacturing, or it can be produced as a separate, elongated and flexible strip. When produced as a separate strip, this element would then be threaded through an ornament attachment slot or eyelet. In either fabrication, the attachment strip is fashioned with self connecting fasteners at its ends (Velcro, buttons, snaps, etc.). The open end of the attachment strip is then looped through the open center portion of the receiving strip and closed, end to end, to itself. This transient interlock allows for temporary attachment and garment to garment interchange of the variety of ornaments.

Further, the ornaments can be fabricated in soft compositions and fiber filled. The primary selection of soft composition ornaments is geared to the younger and/or unstable user wearer. Where flexibility and added safety are not prime considerations, these members may be fabricated of sheet plastic, molded resins or other less flexible materials.

Therefore, it should be clear from the detailed specifications and drawings that the present invention provides a simple, safe and secure mechanism and system for clothing ornamentation. Further, this system affords clothing manufacturers the opportunity to produce generic/non-descript garments which can then become thematic through the wearer's use of interchangeable ornaments, insignias or other display emblems.

Having thus described the invention in detail, we hereby claim:

1. A clothing ornamentation system for releasably attaching ornamental elements to articles of clothing comprising, in combination:

an article of clothing, an ornamental element, interlocked loops of flexible material which fasten said ornamental element to said article, one of said loops comprising a receiving loop formed by a flexible receiving strip of the material fixed at opposite end portions to said article in a manner so that said receiving strip extends substantially horizontally when said article is worn by a wearer, and is spaced from said article behind a central portion, to provide a vertically open center, and another of said loops comprising an attachment loop formed by a flexible attachment strip of the material which extends vertically through the vertically open center of the receiving loop, said attachment strip having releasably secured end portions which allows said portions to be separated and said attachment loop opened and removed from the receiving loop, said attachment loop when interlocked with said receiving loop having a vertical portion in front of said central portion of said receiving loop, and a fastener securing said ornamental element to said vertical front portion of said attachment loop which supports said ornamental element in a position in front said attachment loop.

2. The system in accordance with claim 1 wherein the open center of the mounted receiving loop is of a width greater than the width of the attachment strip where the latter extends through the open center.

3. The system in accordance with claim 1 wherein the receiving strip is fabricated with a label which is exposed on a surface thereof.

4. The system in accordance with claim 1 wherein the receiving strip is fabricated of material similar in at least one of pattern and color to that of the article upon which it is fixed.

5. The system in accordance with claim 1 wherein the attachment strip is of a sufficient width and length as to allow one end of same to be passed through the open center of the receiving loop.

6. The system in accordance with claim 5 wherein the attachment strip length is further sufficient as to allow it's ends to close to each other by releasably securing means and thus to form an attachment loop.

7. The system in accordance with claim 6 wherein the ends of the attachment strip utilize a clasping mechanism for releasably securing.

8. The system in accordance with claim 6 wherein the ends of the attachment strip utilize a hooking material mechanism for releasably securing.

9. The system in accordance with claim 1 wherein the attachment strip is permanently anchored to the ornamental element.

10. The system in accordance with claim 1 wherein the attachment strip is temporarily attached to the ornamental element.

11. The system in accordance with claim 10 wherein the attachment strip is temporarily attached by a clip device mounted to the ornamental element.

12. The system in accordance with claim 1 wherein all system components are made of flexible material.

13. The system in accordance with claim 1 wherein, for wearer safety, the ornamental element is filled with soft material.

14. The system in accordance with claim 12 wherein the ornamental element includes plastic materials.

* * * * *